US005595116A

United States Patent [19]

Ohkawara

[11] Patent Number: 5,595,116

[45] Date of Patent: Jan. 21, 1997

[54] DAMPENING APPARATUS OF LITHOGRAPHIC PRINTING MACHINE

[75] Inventor: Tamaki Ohkawara, Kanagawa-ken, Japan

[73] Assignee: Kabushiki Kaisha Tokyo Kikai Seisakusho, Japan

[21] Appl. No.: 427,175

[22] Filed: Apr. 24, 1995

[30] Foreign Application Priority Data

Sep. 30, 1994 [JP] Japan ..... 6-236261

[51] Int. Cl.[6] ..... B41L 23/00

[52] U.S. Cl. ..... 101/147; 101/148

[58] Field of Search ..... 101/147, 148

[56] References Cited

U.S. PATENT DOCUMENTS

| | | | |
|---|---|---|---|
| 4,050,378 | 9/1977 | Smith | 101/147 |
| 4,708,058 | 11/1987 | Smith | 101/147 |
| 4,848,228 | 7/1989 | Svoboda et al. | 101/148 |
| 5,025,722 | 6/1991 | Switall et al. | 101/147 |
| 5,040,457 | 8/1991 | Lin | 101/147 |
| 5,438,923 | 8/1995 | Schoeps | 101/147 |

FOREIGN PATENT DOCUMENTS

| | | | |
|---|---|---|---|
| 3928072 | 9/1939 | Japan . | |
| 63-72549 | 4/1988 | Japan . | |
| 321452 | 1/1991 | Japan . | |
| 1404808 | 9/1975 | United Kingdom | 101/147 |

*Primary Examiner*—Edgar S. Burr
*Assistant Examiner*—Anthony H. Nguyen
*Attorney, Agent, or Firm*—Ronald P. Kananen

[57] ABSTRACT

A dampening apparatus of a lithographic printing machine in which a dampening train constituted by a roller or rollers is arranged and a dampening liquid is supplied to a printing plate through the dampening train, comprises a spraying mechanism facing a peripheral surface of a roller of the dampening train with a space therefrom and disposed along an axis of the roller, the spraying mechanism containing a plurality of nozzles directing to the peripheral surface of the roller, a cover unit disposed in the space between the spraying mechanism and the roller and having a roller side cover opened and a spraying mechanism side cover closed, the cover unit having a structure extendable and retractable between the roller side cover and the spraying mechanism side cover, and movement adjusting means for adjusting relative movement of the roller side cover and the spraying mechanism side cover so as the spraying mechanism side portion of the cover unit and the spraying mechanism may move close to or apart from the peripheral surface of the roller, the movement adjusting means is connected with the spraying mechanism and the spraying mechanism side cover. A mechanism for positioning the roller side of the cover unit with respect to the peripheral surface of the roller is further disposed.

14 Claims, 7 Drawing Sheets

DAMPENING APPARATUS OF LITHOGRAPHIC PRINTING MACHINE

BACKGROUND OF THE INVENTION

The present invention relates to a dampening apparatus of a lithographic printing machine or press and more particularly to a nozzle-spray type dampening apparatus thereof including a plurality of nozzles through which dampening liquid is supplied to rollers constituting a dampening train and then supplied to a printing plate through the dampening train.

Such a nozzle-spray type dampening apparatus is for example disclosed in Japanese Utility Model Publication No. SHO 39-28072, Japanese Patent Laid-open Publication No. SHO 63-72549 and Japanese Patent Laid-open Publication No. HEI 3-21452.

The dampening apparatus disclosed in the above known publications are each provided with a cover, as disclosed in detail in the Japanese Utility Model Publication No. SHO 39-28072, for preventing a sprayed dampening liquid from scattering to undesired portions so as the portions may not rust.

In the Japanese Patent Laid-open Publication No. HEI 3-21452, there is disclosed a mechanism for adjusting a distance between a spraying device including nozzles and a peripheral surface of a roller to which the dampening liquid is supplied, as occasion demands, and in the Japanese Patent Laid-open Publication No. SHO 63-72549, there is disclosed a mechanism for easily mounting and dismounting a spraying mechanism to and from a printing machine.

Further, the Japanese Utility Model Publication No. SHO 39-28072 discloses a mechanism for adjusting the spraying amount of the dampening liquid by moving a front end of a spray nozzle, but this mechanism is one for changing an opening degree of the spray nozzle and not one for adjusting a distance between the spraying mechanism and the peripheral surface of the roller to which the dampening liquid is supplied.

In general, the nozzle-spray type dampening apparatus is an apparatus for supplying the dampening liquid to the roller in shape of sector widening in the axial direction of the roller, and in such apparatus, in order to substantially uniformly supply the dampening liquid to the roller surface along the axial direction thereof through a plurality of nozzles arranged side by side, when the spraying device including the nozzles is mounted, it is necessary to properly adjust the distance between the nozzles and the peripheral surface of the roller.

In the nozzle-spray type dampening apparatus disclosed in the Japanese Utility Model Publication No. SHO 39-28072 and the Japanese Patent Laid-open Publication No. SHO 63-72549, stationary structures are employed in which the spraying mechanisms are stationarily located with respect to the rollers to which the dampening liquid is sprayed, and hence, it is difficult to adjust the distance between the spraying mechanism and the roller after the assembling together. Accordingly, when the spraying mechanism and the roller are assembled, it was required to assemble them with high accuracy, resulting in lowering of working efficiency and increasing much mental labor of workers.

On the other hand, the nozzle-spray type dampening apparatus disclosed in the Japanese Patent Laid-open Publication No. HEI 3-21452 is provided with a spraying mechanism capable of adjusting the close and apart movement thereof with respect to the roller to which the dampening liquid is sprayed. Thus, the dampening apparatus of this prior art overcomes the above problem encountered in the nozzle-spray type damping devices disclosed in the Japanese Utility Model Publication No. SHO 39-28072 and the Japanese Patent Laid-open Publication No. SHO 63-72549. However, in this prior art dampening device, since the spraying mechanism is moved integrally with the whole structure of a cover unit, a distance between the front end of the cover unit and the peripheral surface of the roller is widened, which results in that the function for preventing the dampening liquid from scattering is degraded and that the dampening liquid is scraped from the roller peripheral surface through the abutment of the front end of the cover unit against the roller peripheral surface. Furthermore, when the close and apart movement of the spraying mechanism is adjusted, it is vertically displaced in response to this movement, and because of this reason, the dampening liquid spraying angle to the roller peripheral surface is changed, which may result in uneven supply of the dampening liquid to the printing surface, thus being inconvenient.

Still furthermore, in the nozzle-spray type dampening apparatus, there may be caused a case wherein a nozzle is clogged by undesired materials contained in the dampening liquid such as scale or slime, thereby preventing the dampening liquid from smoothly supplying, and in order to obviate such defect, it is necessary to inspect, clean and maintain the spraying device by disassembling the same periodically or as occasion demands, thus being troublesome.

In this view point, in the nozzle-spray type dampening apparatus of the Japanese Utility Model Publication No. SHO 39-28072, since the spraying mechanism is constructed to be integral with the cover unit for preventing the dampening liquid from scattering and is attached, through the cover unit, to a frame of a printing machine, no structural consideration is paid to the mounting or dismounting of the spraying mechanism for its maintenance or inspection. Then, in a case when it is required to dismount the spraying mechanism, it is obliged to entirely remove the spraying mechanism and the cover unit together, and moreover, it is required to accurately adjust the position of these mechanisms with respect to the roller peripheral surface to which the dampening liquid is supplied, requiring much time and labor for the worker, thus being troublesome and undesirable for the worker.

The above problems encountered in the prior art of the Japanese Utility Model Publication No. SHO 39-28072 are solved by the nozzle-spray type dampening apparatus of the Japanese Patent Laid-open Publication No. SHO 63-72549 paying the consideration to the dismounting and mounting of the spraying mechanism for the inspection or the like thereof. However, in the dampening apparatus of the latter publication, the freedom for the dismounting or mounting of the spraying mechanism is extremely limited because connecting means for connecting the spraying mechanism and electrical power supply sources for the spraying mechanism, the dampening liquid supply, and the like are fixed to the frame of the printing machine. Furthermore, in the dampening apparatus of this prior art, the spraying mechanism is enclosed in the cover unit, so that when the spraying mechanism is removed, it is necessary to pay an attention to the removal of the cover unit, thus being inconvenient.

Still furthermore, in the nozzle-spray type dampening apparatus disclosed in the Japanese Patent Laid-open Publication No. HEI 3-21452, it is considered to mount or dismount the spraying mechanism more easily for inspection, for example. That is, a frame of a printing machine is formed with a U-shaped receiving portion opened obliquely upward and an end portion of the spraying mechanism is held by the receiving portion with its rotation being limited. This arrangement solves the problem involved in the apparatus disclosed in the Japanese Patent Laid-open Publication No. SHO 63-72549 as mentioned above. However, in the dampening apparatus of the HEI 3-21452 publication, the spraying mechanism must be mounted or dismounted together with the cover unit, and accordingly, when the spraying mechanism is dismounted or mounted, it must be handled together with the cover unit and the total weight to be handled is heavy, and the center of gravity is at the side of the spraying mechanism, thus being troublesome and inconvenient.

SUMMARY OF THE INVENTION

An object of the present invention is to substantially eliminate defects or drawbacks encountered in the prior art described above and to provide a dampening apparatus of a lithographic printing machine capable of easily adjusting the close and apart movement of a spraying mechanism for spraying a dampening liquid to a peripheral surface of a roller of a dampening train without changing a spraying angle of nozzles of the spraying mechanism.

Another object of the present invention is to provide a dampening apparatus of a lithographic printing machine capable of performing the close and apart movement of the spraying mechanism without influencing on the function of a cover unit disposed between the spraying mechanism and the roller.

A further object of the present invention is to provide a dampening apparatus of a lithographic printing machine provided with a spraying mechanism having a solely detachable structure.

These and other objects can be achieved according to the present invention by providing a dampening apparatus of a lithographic printing machine in which a dampening train constituted by a roller or rollers is arranged and a dampening liquid is supplied to a printing plate through the dampening train, the dampening apparatus comprising:

a spraying mechanism facing a peripheral surface of a roller of the dampening train with a space therebetween and disposed along an axis of the roller, the spraying mechanism containing a plurality of nozzles directing to the peripheral surface of the roller;

a cover unit disposed in the space between the spraying mechanism and the roller and having a roller side portion opened and a spraying mechanism side portion closed, the cover unit having a structure extendable and retractable between the roller side portion and the spraying mechanism side portion of the cover unit;

movement adjusting means for adjusting relative movement of the roller side portion and the spraying mechanism side portion of the cover unit so as the spraying mechanism side portion of the cover unit and the spraying mechanism may move close to or apart from the peripheral surface of the roller, said movement adjusting means is connected with the spraying mechanism and the spraying mechanism side portion of the cover unit; and means for positioning the roller side portion of the cover unit with respect to the peripheral surface of the roller.

In preferred embodiments, the cover unit comprises a roller side cover member and a spraying mechanism side cover member which are slidably fitted to each other.

The spraying mechanism is detachably mounted. The spraying mechanism is temporarily supported to the cover unit by means of a temporary support means.

The movement adjusting means are provided on both side portions of the cover unit and each of the movement adjusting means comprises a guide member attached to the roller side portion of the cover unit, a splittable portion for clamping and releasing the guide member through a clamping bolt, and an adjustment bar secured to the spraying mechanism side portion of the cover unit and also secured movably to the roller side portion of the cover unit through a screw engagement therebetween. The clamping bolt constitutes a positioning member for positioning the spraying mechanism when a distance between the nozzles of the spraying mechanism and the roller is adjusted to a predetermined distance.

The spraying mechanism is provided with solenoid means for operating the nozzles, respectively, so as to open and close dampening liquid jetting ports of the nozzles.

The roller side portion and the spraying mechanism side portion of the cover unit are integrally connected through a bellows.

The spraying side portion of the cover unit and the spraying mechanism are connected to a common movement adjusting means.

The spraying side portion of the cover unit and the spraying mechanism are connected to different movement adjusting means, respectively. There is disposed a coupling means for selectively connecting and disconnecting, in operation, a movement adjusting means connected to the spraying mechanism side portion of the cover unit and another movement adjusting means connected to the spraying mechanism.

According to the structures and characters of the dampening apparatus of a lithographic printing machine according to the present invention, the movement adjusting means is operated so that the spraying mechanism moves close to or apart from the peripheral surface of the roller in the dampening train to which the dampening liquid is sprayed thereby to uniformly supply the dampening liquid to the peripheral surface of the roller along the axial direction thereof. In association with this movement of the spraying mechanism, the spraying mechanism side portion of the cover unit is moved in the same direction of the movement of the spraying mechanism together therewith or independently to a portion at which the scattering of the dampening liquid can be prevented. Thus, the dampening liquid can be uniformly and accurately supplied to a printing plate of the lithographic printing machine, thereby providing a printed material with high quality. The scattering of the dampening liquid to portions of the printing machine can be also prevented, thus being advantageous for inspection or maintenance thereof.

The cover unit has the structure capable of being extended and retracted in accordance with the movement of the spraying mechanism side portion without changing the positional relationship of the roller side portion of the cover unit with respect to the peripheral surface of the roller, thereby preventing the dampening liquid from scattering even in the movement of the spraying mechanism. When the cover unit is composed of the roller side cover member and the spraying mechanism side cover member, which are fitted to each other in the slidable manner, the expansion or shrinkage of the cover unit is performed by slidably moving the spraying mechanism side cover member with respect to the roller side cover member. This expansion and shrinkage of the cover unit may be performed by arranging the bellows therebetween.

Only the spraying mechanism can be dismounted or mounted in the case of inspection thereof, for example, by operating the connecting portion of the spraying mechanism. In an accident, only the spraying mechanism can be changed with new one, thus being advantageous in operation rate of the printing machine.

After the mounting of the spraying mechanism, the movement adjusting means is operated to adjust the position of the spraying mechanism with respect to the peripheral surface of the roller to which the dampening liquid is supplied.

The nature and further features of the present invention will be made more clear from the following descriptions by way of preferred embodiments with reference to the accompanying drawings.

DESCRIPTION OF THE PREFERRED EMBODIMENTS

A preferred embodiment of the present invention will be described hereunder with reference to the accompanying drawings.

Figure 1:
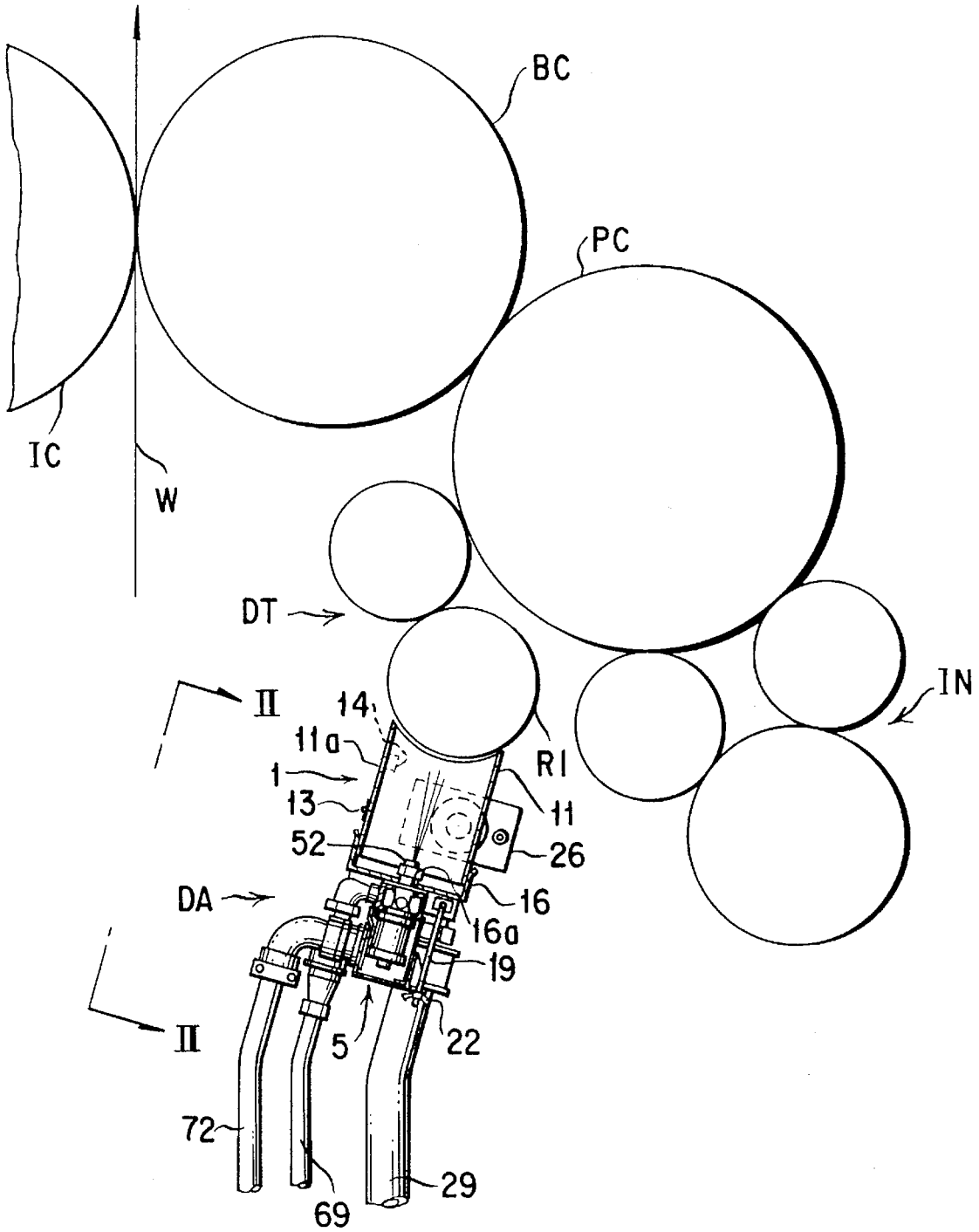
FIG. 1 is a front view, partially in section, of one embodiment of a dampening apparatus, in section, of a lithographic printing machine, according to the present invention.
Figure 2:
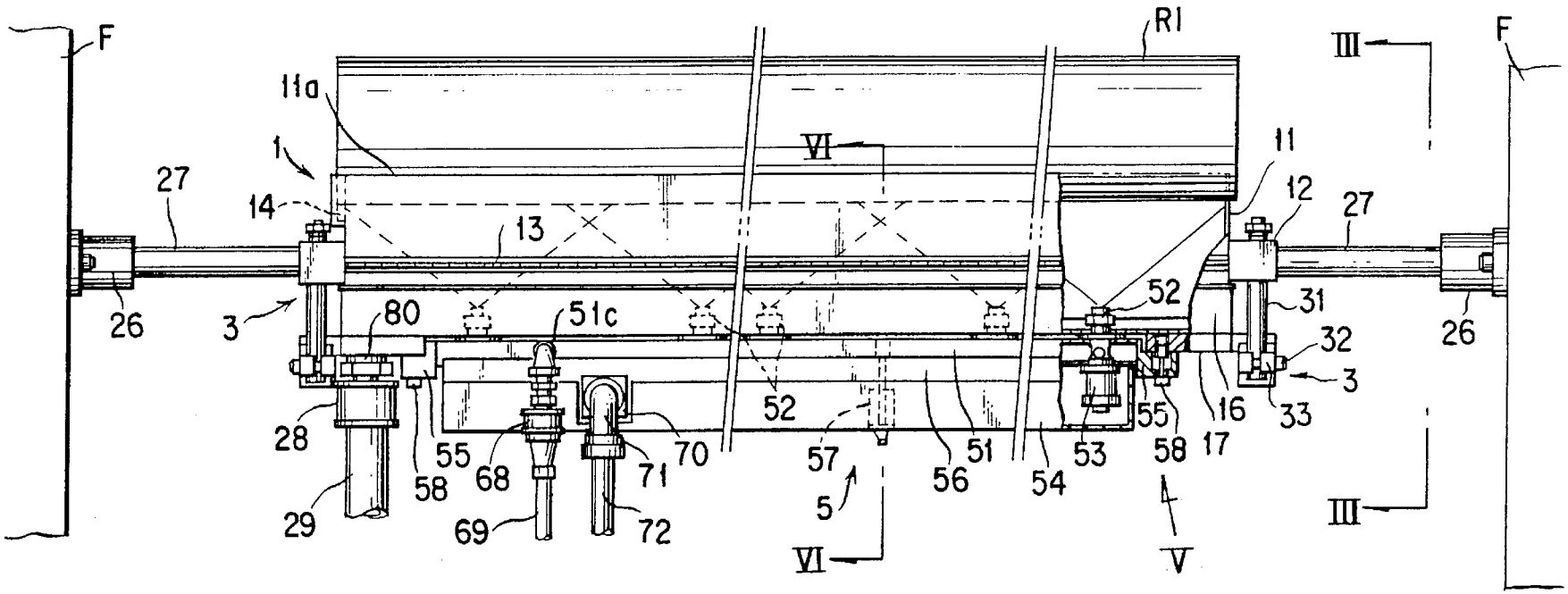
FIG. 2 is a sectional view, partially omitted, taken along the line II—II in FIG. 1.

FIG. 1 shows a front view, partially in section, of a dampening apparatus DA of the present invention mounted to a lithographic offset printing machine and FIG. 2 is a sectional view, partially deleted, taken along the line II—II in FIG. 1.

Referring to FIGS. 1 and 2, a cover unit 1 comprises two cover members 2, which are mutually operatively connected through movement adjusting means 3. A spraying mechanism 5 is mounted to the cover unit 1, and a dampening train DT is comprised of rollers R1 to which a dampening liquid is sprayed. In these figures, reference character IN denotes a portion of an inking device, PC denotes a plate cylinder, BC denotes blanket cylinder, IC denotes an impression cylinder or other blanket cylinder, and W denotes a running web, which is merely called a web W hereinafter.

Figure 3:
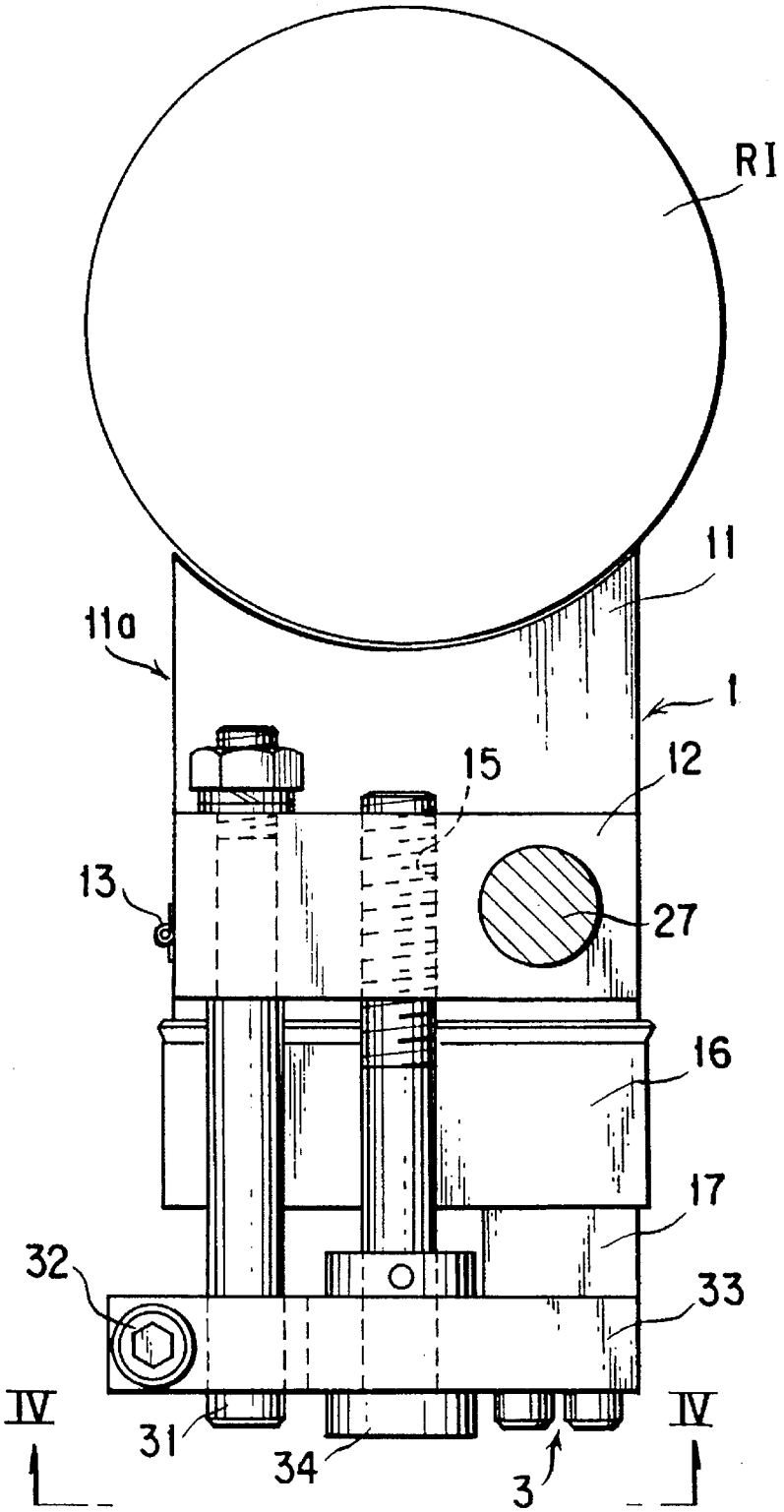
FIG. 3 is a side view in an arrowed direction III—III in FIG. 2.
Figure 4:
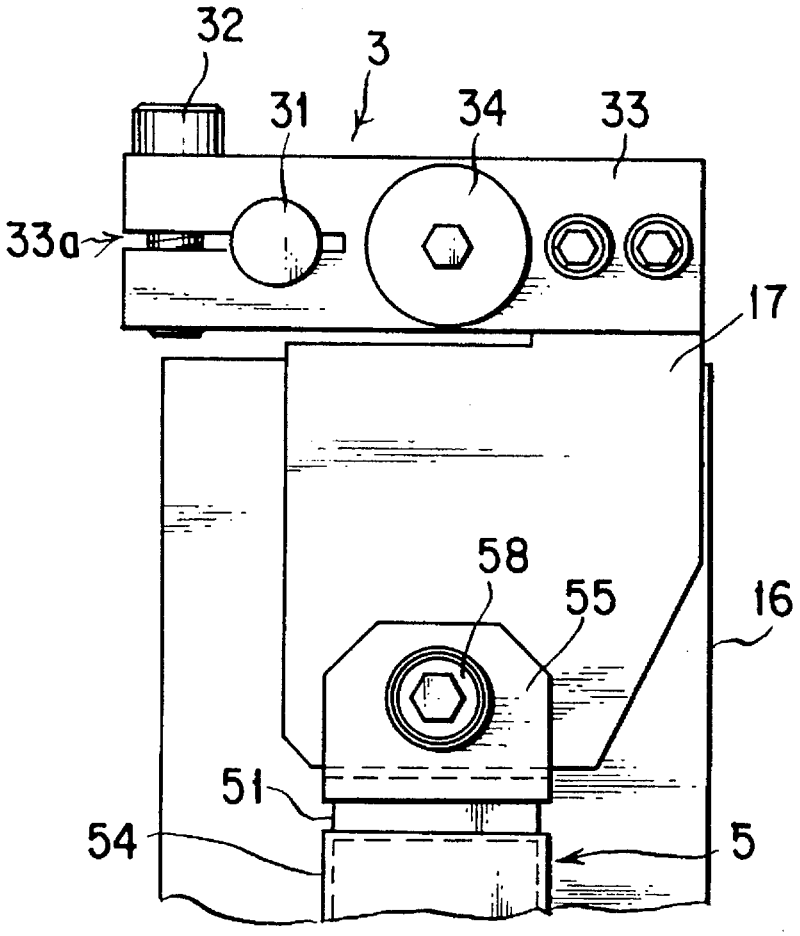
FIG. 4 is a view in an arrowed direction IV—IV in FIG. 3.
Figure 5:
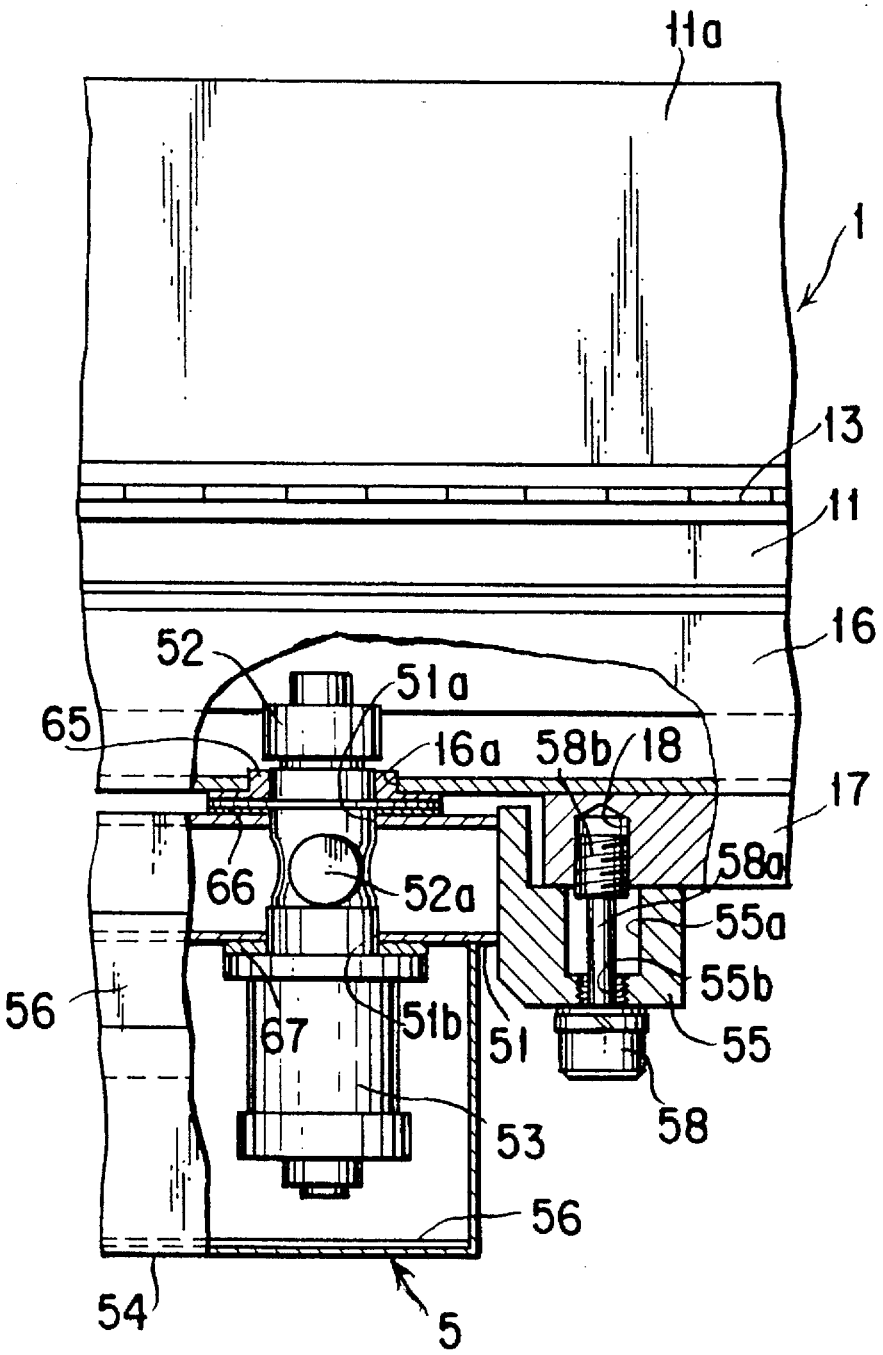
FIG. 5 is an enlarged view, partially in section, of a portion viewed in an arrowed direction V in FIG. 2.
Figure 6:
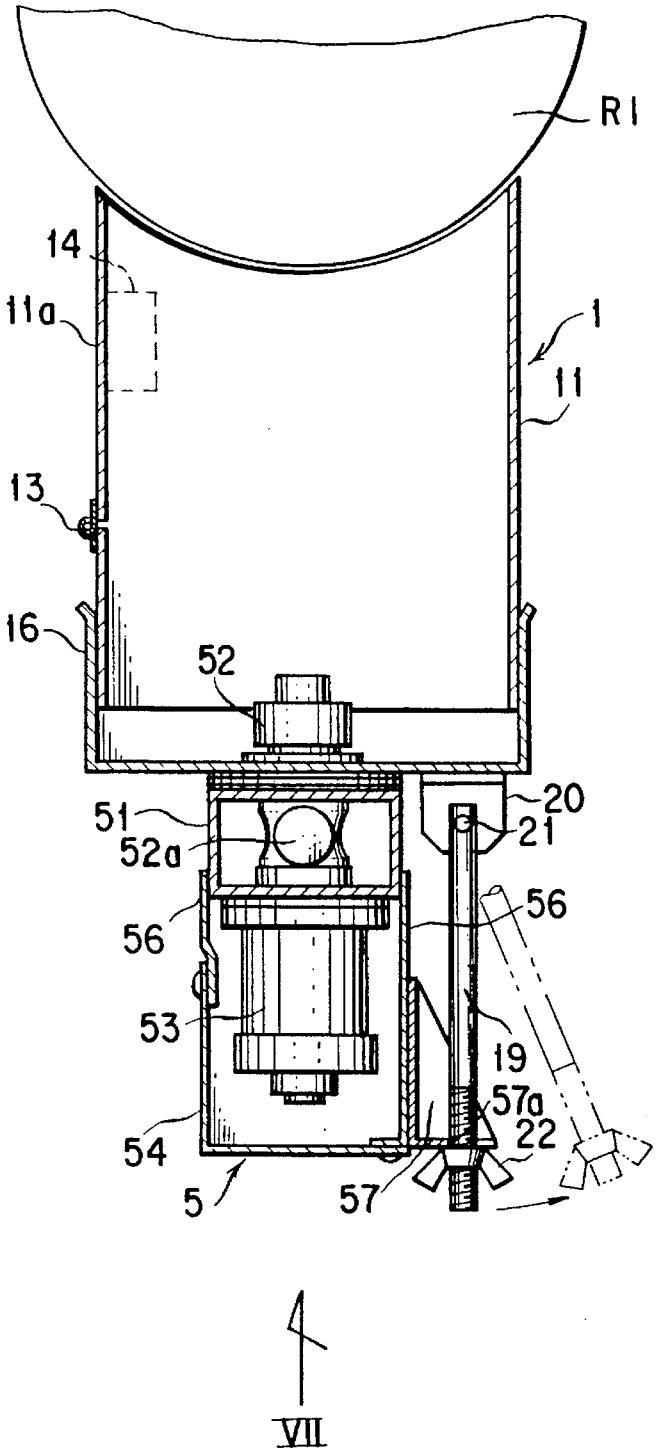
FIG. 6 is a sectional view taken along the line VI—VI in FIG. 2.
Figure 7:
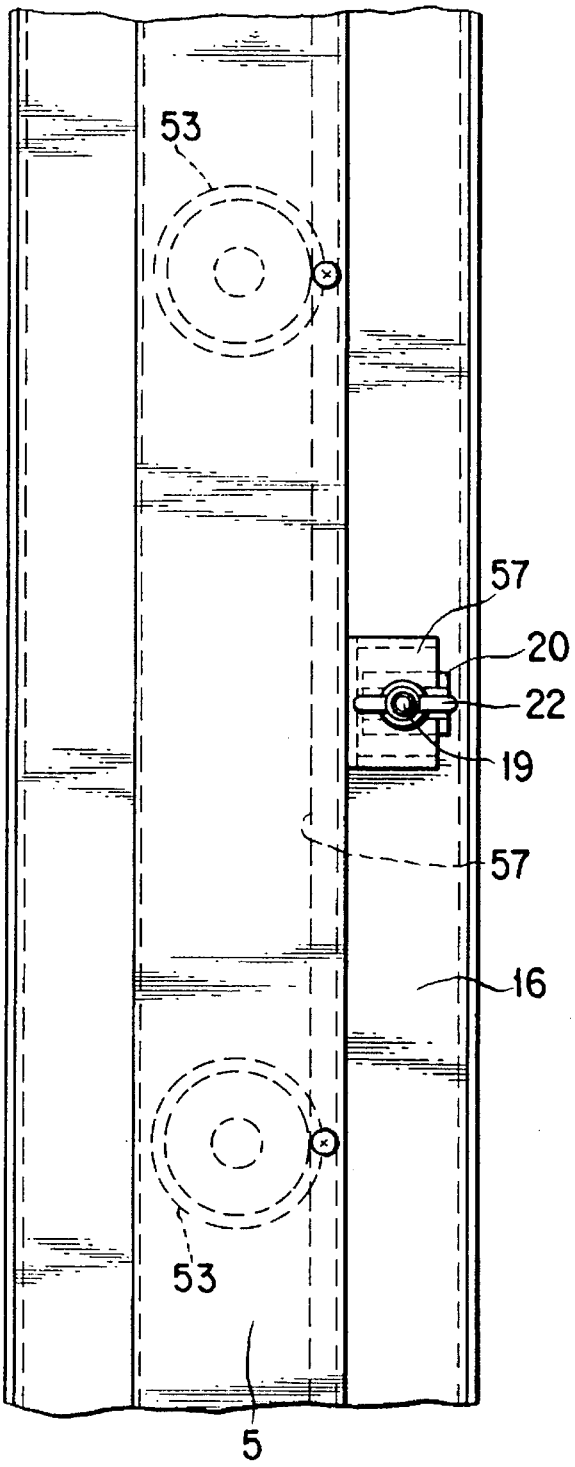
FIG. 7 is a view in an arrowed direction VII—VII in FIG. 6.

FIGS. 3 and 4 are sectional views showing details of the movement adjusting means 3, and FIGS. 5, 6 and 7 are also sectional views showing details of a mounting portion at which the spraying mechanism 5 is mounted to the cover unit 1.

With reference to these figures, the cover unit 1 comprises a roller side cover 11 and a spraying mechanism side cover 16 fitted to the roller side cover 11. The roller side cover 11 is mounted, through a block 12, to a support member 27 which is mounted to a frame F through a bracket 26. The roller side cover 11 has a shape opened at a side close to the roller R1 to which the dampening liquid is supplied and a side opposing thereto, and is positioned fixedly to the roller R1 by an elongated hole, for attachment, of the bracket 26.

The roller side cover 11 has a closed one side having a movable member openable by means of hinge 13 and the movable member 11*a* is adapted to maintain the closed state by a proper holding means 14, for example, a latch mechanism or another fastener mechanism provided at least one of longitudinal both sides of the roller side cover 11.

The spraying mechanism side cover 16 has one side opened, and the spraying mechanism side cover 16 is slidably fitted to the opening of the roller side cover 11 at the opposite side thereof thereby to be connected to the roller side cover 11 through the movement adjusting means 3, which will be explained hereinafter. The spraying mechanism side cover 16 has the other one side to which is formed with a hole 16*a* for nozzle attachment through which a nozzle 52 of the spraying mechanism 5 faces in the manner described hereinafter. Blocks 17 are also provided to the longitudinal end portions of the other one side of the spraying mechanism side cover 16. A discharge tube 80 is disposed so as to penetrate the blocks 17 and the spraying mechanism side cover 16, and another discharge tube 29 is connected through a connector 28 to the discharge tube 80 to be easily detachable so as to recover and discharge an excessive dampening liquid sprayed from the spraying mechanism 5.

Further, a female threaded hole 18 is formed to the block 17 for the attachment of the spraying mechanism 5 to the block 17 as shown in FIG. 5. One end portion of a supporting threaded bar 19 for temporarily supporting the spraying mechanism 5 by the cover unit 1 is rotatably secured to the longitudinal central portion of the spraying mechanism side cover 16 through a bracket 20 and a pin 21, and the threaded bar 19 has another free end portion formed with the male thread with which a nut member such as wing nut 22 having a protruded portion is screwed as shown in FIG. 6.

The movement adjusting means 3 are provided to both longitudinal end portions of the cover unit 1 as shown in FIG. 2. As shown in FIGS. 3 and 4, each of the movement adjusting means 3 comprises a guide bar 31 mounted to the block 12 of the roller side cover 11, a block 33 mounted to the block 17 of the spraying mechanism side cover 16, and an adjustment male threaded bar 34 screwed with a female threaded hole 15 formed to the block 12 of the roller side cover 11. The block 33 is provided with two split portions 33*a* which clamps or releases the guide bar 31 by operating a clamping bolt 32, and the male threaded bar 34 is mounted to the block 33 to be rotatable but limited in its movement in the axial direction.

The spraying mechanism 5 comprises, as shown in FIG. 5, a tube 51 rectangular in section closed at its both ends by blocks 55, 55 each having an L-shaped section, a plurality of nozzles 52, 52,—52 mounted to the rectangular tube 51, solenoid means 53, 53,—53 provided for the nozzles 52, 52,—52, respectively, for opening or closing a valve body, not shown, to close jetting ports of the respective nozzles 52, and a protector cover 54 for protecting the solenoid means 53 and electrical wirings for the solenoid means 53.

The rectangular tube 51 is formed with through holes 51*a* and 51*b* at its parallel surfaces and each nozzle 52 is fitted to the holes 51*a* and 51*b* in the manner such that a head portion of the nozzle 52 provided with a jetting port at its front end projects over the hole 51*a*, a tail end of the nozzle 52 projects over the hole 51*b*, and the central portion thereof is positioned in the rectangular tube 51. The penetrating portions of the nozzle 52 through the rectangular tube 51 are sealed by sealing members 66 and 67, respectively. The rectangular tube 51 is further provided with a receiving port 51*c* to which the dampening liquid from a supply source, not shown, is supplied under pressure, and as shown in FIG. 2, a dampening liquid supply tube 69 is connected to the receiving port 51*c* through a connector 68.

To the outer side of the rectangular tube 51, there is provided a mounting member 56 for mounting a cover 54 to the rectangular tube 51, and as shown in FIGS. 6 and 7, an engaging member 57 formed with a U-shaped cutout 57*a* and engagable with the support male threaded bar 19 attached to the longitudinal central portion of the spraying mechanism side cover 16 is provided for the longitudinal central portion of the rectangular tube 51.

Furthermore, one portion of the attachment member 56 projects so as to provide a rectangular shape and an electric power receiving member such as receptacle 70 for the electrical wiring to the solenoid means is provided to this projected portion of the attachment member 56. An electrical power supply wiring 72 is connected to the electric power receiving member 70 through a connector such as plug 71 to be easily detachable.

The central portion of the nozzle 52 positioned in the rectangular tube 51 has four side surfaces to which dampening liquid receiving ports 52*a* are formed, respectively. The solenoid means 53 is provided for the tail end of the nozzle 52 projecting from the through hole 51*b* of the rectangular tube 51. The solenoid means 53 is energized so as to displace the valve body, which closes the jetting port of the nozzle 52 by an urging force of a compression spring, not shown, in a direction against the urging force applied by the compression spring.

The cover 54 is screwed to the attachment member 56 attached to the rectangular tube 51 so as to protect the solenoid means 53 and the electrical wiring to the solenoid means 53.

As shown in FIG. 5, each of the L-shaped blocks 55, 55 is arranged so that the back side surface of one portion of the block 55 forming the L-shape closes each end of the rectangular tube 51 and the other portion thereof forming the L-shape is formed with a counterbore 55*a* bored from its inside surface and with a female threaded hole 55*b* formed from its back side surface coaxially with the counterbore 55*a* so as to be communicated therewith. A mounting screw 58 for mounting the spraying mechanism 5 to the block 17 of the spray mechanism side cover 16 penetrates the female threaded hole 55*b* and the head thereof is engaged with the other portion of the block 55. The same screw thread as that of the female threaded hole 18 of the block 17 is formed to the female threaded hole 55*b*.

The mounting screw 58 has a shank portion 58*a* having an axial length longer than the thickness of the other portion of the L-shaped portion of the block 55 and is formed at its front end with a male threaded portion 58*b* having a length shorter than the depth of the counterbore 55*a*. The rest of the shank portion 58*a* has a diameter smaller than that of a bottom portion of the thread of the female threaded portion 55*b*.

The spraying mechanism 5 is mounted to the cover unit 1 by screw engaging the male threaded portion 58*b* of the mounting screw 58 with the female threaded hole 18 of the block 17 of the spraying mechanism side cover 16, and in this mounting, a seal member 65 is interposed between the nozzle hole 16*a* of the spraying side cover 16 and the nozzle 52 so as to seal the mounted portion.

Furthermore, in the described structure, the clamping bolt 32 and the adjustment male screw bar 34 of the movement adjusting means 3 and the mounting screw 58 of the spraying mechanism 5 employ the hexagonal socket head structures, but they may be substituted with ones, such as wing bolts, having heads on which operational protruded portions are formed.

The embodiment of the structure described above will operates in the following manner.

In the lithographic offset printing machine or press shown in FIG. 1, the dampening liquid is supplied to a printing plate, not shown, mounted to the plate cylinder PC, by means of the dampening apparatus DA and an ink is also supplied to the printing plate by means of the inking device IN. The printing image on the printing plate is printed on the web W passing through the blanket cylinder BC and the impression cylinder IC through a surface of the bracket cylinder BC.

During this printing process, the solenoid means 53 in the dampening apparatus DA is operated under suitable control, and the jetting ports of the nozzles 52 are intermittently opened and closed. When the jetting port of the nozzle 52 is opened, the dampening liquid now supplied under pressure is jetted through the jetting port by the applied pressure. The dampening liquid thus jetted is sprayed toward the roller R1 opposing to the jetting port of the nozzle 52 and then fed to the printing plate through the rotations of rollers of the dampening train DT.

In the dampening apparatus DA according to the present invention, the nozzle 52 is set such that the spraying amount of the dampening liquid and the splashing angle of the nozzle 52 are determined so that when the nozzle 52 of the spraying mechanism 5 is positioned apart from the dampening roller R1 to be sprayed by a predetermined distance, the dampening liquid of necessary amount can be supplied substantially uniformly along the axial direction of the dampening roller R1. On the other hand, in a case that the distance between the nozzle 52 and the dampening roller R1 is not proper, the dampening liquid will be supplied in a reduced or excessive amount to the printing plate or supplied partially unevenly. In order to obviate such defects, it is necessary to adjust properly the distance between the nozzle 52 and the roller R1 by means of the movement adjusting means at a time of mounting the dampening apparatus DA or as occasion demands.

That is, when the distance adjustment is required, the clamping bolt 32 is first loosened to separate the splittable portions 33 thereby to release the guide bar 31 and the adjustment male threaded bar 34 is then rotated in a desired direction. Thus, the adjustment male threaded bar 34 is displaced in the axial direction in association with the female threaded hole 15 of the block 12 fixed to the frame F through the support member 27 and the bracket 26, and hence, the entire structure of the spraying mechanism 5 is moved, through the blocks 33 and 17, all at once close or apart from the dampening roller R1.

Such adjusting operation is carried out by operating the movement adjusting means 3 disposed on both sides of the spraying mechanism 5 together all at once or slightly in an alternating manner so that the longitudinal both side portions of the spraying mechanism 5 are movable substantially uniformly. In accordance with the operation of the movement adjusting means 3, the spray mechanism side cover 16 of the cover unit 1 is moved together through the blocks 33 and 17, and the cover unit 1 is extended or retracted at a portion at which the roller side cover 11 and the spraying mechanism side cover 16 are fitted together in an overlapped manner.

Upon the completion of the adjustment of the distance between the nozzle 52 and the roller R1, the clamping bolt 32 is fastened thereby to hold the guide bar 31 between the splittable portions 33*a*, thus adjusting the position of the spraying mechanism 5. The spraying mechanism side cover 16 is also positioned in accordance with the positioning of the spraying mechanism 5.

In a case where it is required to inspect or adjust the nozzle 52 because of periodical inspection or other reasons, the spraying mechanism 5 is removed by first loosening the mounting screw 58 and then removing it from the female threaded hole 18 of the block 17 of the spraying mechanism side cover 16. In this operation, the male threaded portion of the mounting screw removed from the female threaded hole 18 is accommodated in the counterbore 55*a* of the block 55, and because the diameter of the thread ridge of the male threaded portion of the mounting screw is larger than the diameter of the bottom portion of the female threaded hole 55*b* of the block 55, the mounting screw 58 remains in the counterbore 55*a* in engagement with the block 55, thus eliminating fear of dropping out or losing the mounting screw 58.

The disengagement of the mounting screws 58 on both the longitudinal sides of the spraying mechanism 5 from the block 17 of the spraying mechanism side cover 16 provides a temporary support state of the spraying mechanism 5 through the engagement with the temporary support threaded bar 19 of the spraying mechanism side cover 16 and the wing nut 22 engaged with the threaded bar 19, whereby the spraying mechanism 5 is temporarily supported by the spraying mechanism side cover 16 through the engaging member 57, the wing nut 22, the temporary support male threaded bar 19, the pin 21 and the bracket 20.

Then, the wing nut 22 is loosened, and the temporary support male threaded bar 19 is rotated about the pin 21 thereby to remove the U-shaped cutout of the engaging member 57, thus enabling the spraying mechanism 5 to be removed.

The mounting of the spraying mechanism 5 will be performed in a manner reverse to the removing manner described above.

The spraying mechanism 5 can be mounted or dismounted by one person extremely effectively by providing the temporary support mechanism for the spraying mechanism 5 constituted by the structure in which the temporary support male threaded bar 19 and the wing nut 22 engagable with the threaded bar 19 are engaged with the engaging member 57. That is, for example, in a case where such temporary support mechanism is not provided, it is difficult for one person to remove simultaneously both the mounting screws 58, 58 disposed at both the longitudinal sides of a spraying mechanism having a relatively long length, and in such case, he first removes one mounting screw and then removes the other one while supporting the removed side of the spraying mechanism by himself.

Such difficulty can be eliminated by providing the temporary support mechanism of the structure described above according to the present invention, and the spraying mechanism can be easily mounted or dismounted by one operator. After the re-mounting of the spraying mechanism, when it is required to adjust the distance between the nozzle 52 and the roller R1, this adjustment will be performed by operating the movement adjusting means 3 in the manner described hereinbefore.

The present invention is not limited to the described embodiment and many other modifications or changes can be made.

For example, in one modification, the spraying mechanism side cover and the roller side cover may be constituted integrally with each other by interposing a member in shape of bellows therebetween so that the cover unit is extendable and retractable through the expansion and shrinkage of the bellows. In another modification, the spraying mechanism may be directly connected to the movement adjusting means so that the spraying mechanism side cover may be connected to the movement adjusting means through the spaying mechanism. In addition, the spraying mechanism and the spraying mechanism side cover are connected to different movement adjusting means, respectively, so that the spraying mechanism and the spraying mechanism side cover are adjusted in their movements independently without interfering to each other.

Furthermore, in the arrangement in which the spraying mechanism and the spraying mechanism side cover are connected to different movement adjusting means, respectively, both the movement adjusting means are changeable to be interlocked or not in operations by means of gears arranged movable between the operative position and inoperative position so that the interlocking or not-interlocking operation is selectively changeable as occasion demands.

What is claimed is:

1. A dampening apparatus of a lithographic printing machine in which a dampening train includes at least one roller and which is arranged so that a dampening liquid is supplied to a printing plate through the dampening train, the dampening apparatus comprising:

a spraying mechanism facing a peripheral surface of the roller of the dampening train, said spraying mechanism being spaced from the roller and parallel with an axis of the roller, said spraying mechanism being provided with a plurality of nozzles each directed toward the peripheral surface of the roller;

a cover unit enclosing a space between the spraying mechanism and the roller for preventing dampening liquid sprayed from the spraying mechanism from scattering away from the roller, said cover unit having at least a roller side cover positioned fixedly with respect to the roller, and a spraying mechanism side cover fitted to the roller side cover;

movement adjusting means connected with the spraying mechanism and the spraying mechanism side cover for moving the spraying mechanism and the spraying mechanism side cover toward and away from the peripheral surface of the roller so as to adjust a distance between the spraying mechanism and the roller.

2. A dampening apparatus of a lithographic printing machine in which a dampening train includes at least one roller and which is arranged so that a dampening liquid is supplied to a printing plate through the dampening train, the dampening apparatus comprising:

a spraying mechanism facing a peripheral surface of the roller of the dampening train, said spraying mechanism being spaced from the roller and parallel with an axis of the roller, said spraying mechanism being provided with a plurality of nozzles each directed toward the peripheral surface of the roller;

a cover unit enclosing a space between the spraying mechanism and the roller for preventing dampening liquid sprayed from the spraying mechanism from scattering away from the roller, said cover unit having at least a roller aide cover positioned fixedly with respect to the roller, and a spraying mechanism side cover fitted to the roller side cover; and movement adjusting means connected with the spraying mechanism and the spraying mechanism side cover for moving the spraying mechanism and the spraying mechanism side cover toward and away from the peripheral surface of the roller so as to adjust a distance between the spraying mechanism and the roller, said movement adjusting means being provided an both side portions of the cover unit and each of the movement adjusting means comprising a guide member attached to the roller side portion of the cover unit, a splittable portion for clamping the guide member through a clamping means, and an adjustment bar secured to the spraying mechanism side portion of the cover unit and also secured movably to the roller side portion of the cover unit.

3. A dampening apparatus of a lithographic printing machine according to claim 2, wherein said spraying mechanism is provided with solenoid means for operating said nozzles, respectively, the solenoid means opening and closing dampening liquid jetting ports of the nozzles.

4. A dampening apparatus of a lithographic printing machine according to claim 2, wherein said roller side portion and said spraying mechanism side portion of the cover unit are integrally connected through a bellows.

5. A dampening apparatus of a lithographic printing machine according to claim 2, wherein said spraying side portion of the cover unit and the spraying mechanism are connected to a common movement adjusting means.

6. A dampening apparatus of a lithographic printing machine according to claim 5, wherein said spraying mechanism is connected to the movement adjusting means through the spraying mechanism side portion of the cover unit.

7. A dampening apparatus of a lithographic printing machine according to claim 5, wherein said spraying mechanism side portion of the cover unit is connected to the movement adjusting means through the spraying mechanism.

8. A dampening apparatus of a lithographic printing machine according to claim 7, further comprising: coupling means for selective connecting a first movement adjusting means connected to the spraying side portion of the cover unit and a second movement adjusting means connected to the spraying mechanism.

9. A dampening apparatus of a lithographic printing machine according to claim 2, wherein said spraying side portion of the cover unit and said spraying mechanism are connected to different movement adjusting means, respectively.

10. A dampening apparatus of a lithographic printing machine according to claim 2, wherein said adjustment bar is movably secured to the roller side portion through a screw engagement therebetween.

11. A dampening apparatus of a lithographic printing machine according to claim 2, wherein said clamping means is a clamp bolt constituting a positioning member for positioning the spraying mechanism when a distance between the nozzle and the roller is adjusted to a predetermined distance.

12. A dampening apparatus of a lithographic printing machine in which a dampening train includes at least one roller and which is arranged so that a dampening liquid is supplied to a printing plate through the dampening train, the dampening apparatus comprising:

a spraying mechanism facing a peripheral surface of the roller of the dampening train, said spraying mechanism being spaced from the roller and parallel with an axis of the roller, said spraying mechanism being provided with a plurality of nozzles each directed toward the peripheral surface of the roller;

a cover unit enclosing a space between the spraying mechanism with the roller for preventing dampening liquid sprayed from the spraying mechanism from scattering away from the roller, said cover unit having at least a roller side cover positioned fixedly with respect to the roller; and a spraying mechanism side cover fitted to the roller side cover; and movement adjusting means connected with the spraying mechanism and the spraying mechanism side cover for moving the spraying mechanism and the spraying mechanism side cover toward and away from the peripheral surface of the roller so as to adjust a distance between the spraying mechanism and the roller, said roller side cover having a first end close to the roller and a second end opposite to the first end, said first and second ends being open, said spraying mechanism side cover having a first end close to the roller side cover, said spraying mechanism being slidably fitted into said roller side cover through the second end of the roller side cover.

13. A dampening apparatus of a lithographic printing machine according to claim 12, wherein said spraying mechanism is detachably disposed in the spraying mechanism side cover through mounting members and is temporarily supported on the spraying mechanism side cover through a temporary support means so that when the mounting members are removed, the spraying mechanism is supported by the temporary support means.

14. A dampening apparatus of a lithographic printing machine according to claim 13, wherein said temporary support means comprises and engaging member mounted on the spraying mechanism, a temporary support male threaded member mounted on the spraying mechanism side cover and a nut member engageable with the threaded member, said temporary support male threaded member and nut member being engaged with the engaging member of the spraying mechanism.

* * * * *